United States Patent [19]

Brighigna

[11] 4,279,194

[45] Jul. 21, 1981

[54] HYDROSTATIC UNIT WITH AXIAL PISTONS HAVING A VARIABLE STROKE VOLUME

[75] Inventor: Mario Brighigna, Ferrara, Italy

[73] Assignee: Stabilimenti Meccanici VM S.p.A., Italy

[21] Appl. No.: 37,086

[22] Filed: May 8, 1979

[30] Foreign Application Priority Data

Nov. 30, 1978 [IT] Italy ..... 30360

[51] Int. Cl.[3] ..... F016 13/02

[52] U.S. Cl. ..... 91/483

[58] Field of Search ..... 91/482, 505, 506

[56] References Cited

U.S. PATENT DOCUMENTS

| | | | |
|---|---|---|---|
| 2,177,008 | 10/1939 | Snader et al. | 91/499 |
| 3,073,252 | 1/1963 | Kamps et al. | 91/482 |
| 3,089,427 | 5/1963 | Firth et al. | 91/482 |
| 3,156,192 | 11/1964 | Austin et al. | 91/506 |
| 3,204,569 | 9/1965 | Firth et al. | 91/482 |
| 3,630,026 | 12/1971 | Field | 91/506 |

FOREIGN PATENT DOCUMENTS

| | | | |
|---|---|---|---|
| 2839631 | 3/1979 | Fed. Rep. of Germany | 91/506 |
| 1263081 | 2/1972 | United Kingdom | 91/482 |
| 1337548 | 11/1973 | United Kingdom | 91/506 |

*Primary Examiner*—William L. Freeh

*Attorney, Agent, or Firm*—Karl W. Flocks

[57] ABSTRACT

Hydrostatic unit is disclosed of the kind having axial pistons and a variable stroke volume, in which a distributor body is rotatable about an axis inclined relative to the axis of a driving shaft and rotatably carries a cylinder block so that the axis of rotation of the cylinder block passes through the point of intersection of the axes of the distributor body and the driving shaft, the improvement consisting in that a phase-adjusting plate is inserted between the cylinder block and the distributor body and has ports equal to the distribution ports of the distributor body, it being possible to rotate the plate about the axis of the cylinder block so as to allow for the shifts of the dead centers of the pumping pistons relative to the distribution ports of the distributor body.

2 Claims, 3 Drawing Figures

HYDROSTATIC UNIT WITH AXIAL PISTONS HAVING A VARIABLE STROKE VOLUME

This invention relates to a few improvements introduced in a hydrostatic unit with axial pistons having a variable stroke volume, of the kind disclosed in the U.S. Patent Application Ser. No. 940.683 filed on Sept. 8, 1978.

In the above cited application there is disclosed and shown a hydrostatic unit with axial pistons, in which the distributor body is rotatable on command about an axis inclined with respect to that of the driving shaft and carries for rotation the cylinder block in such a way that the axis of rotation of the latter passes through the point of intersection between the axes of the distributor body and the driving shaft and that it is, in its turn, inclined with respect to the axis of the distributor body by an angle which is just slightly wider than the angle formed between the axis of the distributor body and the axis of the driving shaft.

In such a hydrostatic unit, the variation of the stroke volume is thus achieved by effecting, by the rotation of the distributor body, a conical rotation of the axis of the cylinder block between a position of maximum slope with respect to the axis of the driving shaft, and thus a position of maximum stroke volume, in which the two angles referred to above are summed, and a position of minimum slope, and thus a position of minimum stroke volume, in which said two angles are subtracted from one another.

The hydrostatic unit constructed according to the present application has proven to afford a number of advantages. It has been possible to ascertain, however, by trials, that which has then been confirmed also by complex mathematical calculations which are omitted for the sake of brevity, that in such a hydrostatic unit, each increase of the stroke volume from the minimum to the maximum value is undesirably accompanied by a progressive and concordant shift of the dead centres of the piston relative to the correct central position with respect to the distribution ports which open in the distributor.

The principal object of the present invention is thus to offset the shortcoming indicated above, by causing the dead centres to stay correctly centred with respect to the distribution ports for any value of the stroke volume.

Having this object in view, the hydrostatic unit according to the present invention is characterized in that it comprises a phase-adjusting plate inserted between the cylinder block and the corresponding surface of the distributor, said plate having formed therethrough a set of ports identical with the distributing ports of said distributor and communicating therewith, said phase-adjusting plate being rotatable about the axis of the cylinder block, means being provided, responsive to every rotation of the distributor about its own axis by a simultaneous and opposite rotation of the phase-adjusting plate about the axis of the cylinder block through such an angle as to maintain the dead centres of the pistons centred with respect to the ports of the phase-adjusting plate so as to allow for the displacement of the dead centres with respect to the distribution ports of said distributor.

While it is apparent that nothing can prevent the displacements of the dead centres of the pistons relative to the distribution ports of the distributor as the stroke volume is being varied, the phase-adjusting plate provided in the hydrostatic unit according to the present invention substantially permits to offset such a displacement by providing an appropriate rotation in the contrary direction so as to keep constantly centred the dead centres with respect to the attendant ports, the latter communicating, in their turn, with the distribution ports.

According to a preferred embodiment of the hydrostatic unit according to the present invention, provision is also made in order that the distribution ports of the distributor body, and thus also the ports formed through the phase-adjusting plate, are shifted through 90 degrees relative to those of the main application, that is to say that such ports are extended transversally of the line which conjoins the axes of rotation of the distributor body and the cylinder block. This circumstance brings about a reversal of the positions of the upper and the lower dead centres as the direction of rotation of the distributor body is varied starting from the position of minimum stroke volume; thus, the reversal of the direction of delivery is made possible when the hydrostatic unit is being used like a pump, without resorting to the reversal of the rotation of the drive shaft.

In addition, it is preferred to have the two angles formed between the axis of rotation of the distributor body and the axis of the driving shaft equal to one another, the same being true also of the angle between the axis of cylinder block and the axis of rotation of the distributor, respectively. Such a provision makes it possible, when the distributor is in the angular position of "0" (zero), to have an unobjectionable alignment of the axes of the cylinder block and the driving shaft, the result being a stroke volume of zero.

The features of the present invention will better be understood by examining the ensuing detailed description of a practical embodiment of the invention, illustrated by way of example in the accompanying drawings, wherein.

Figure 1:
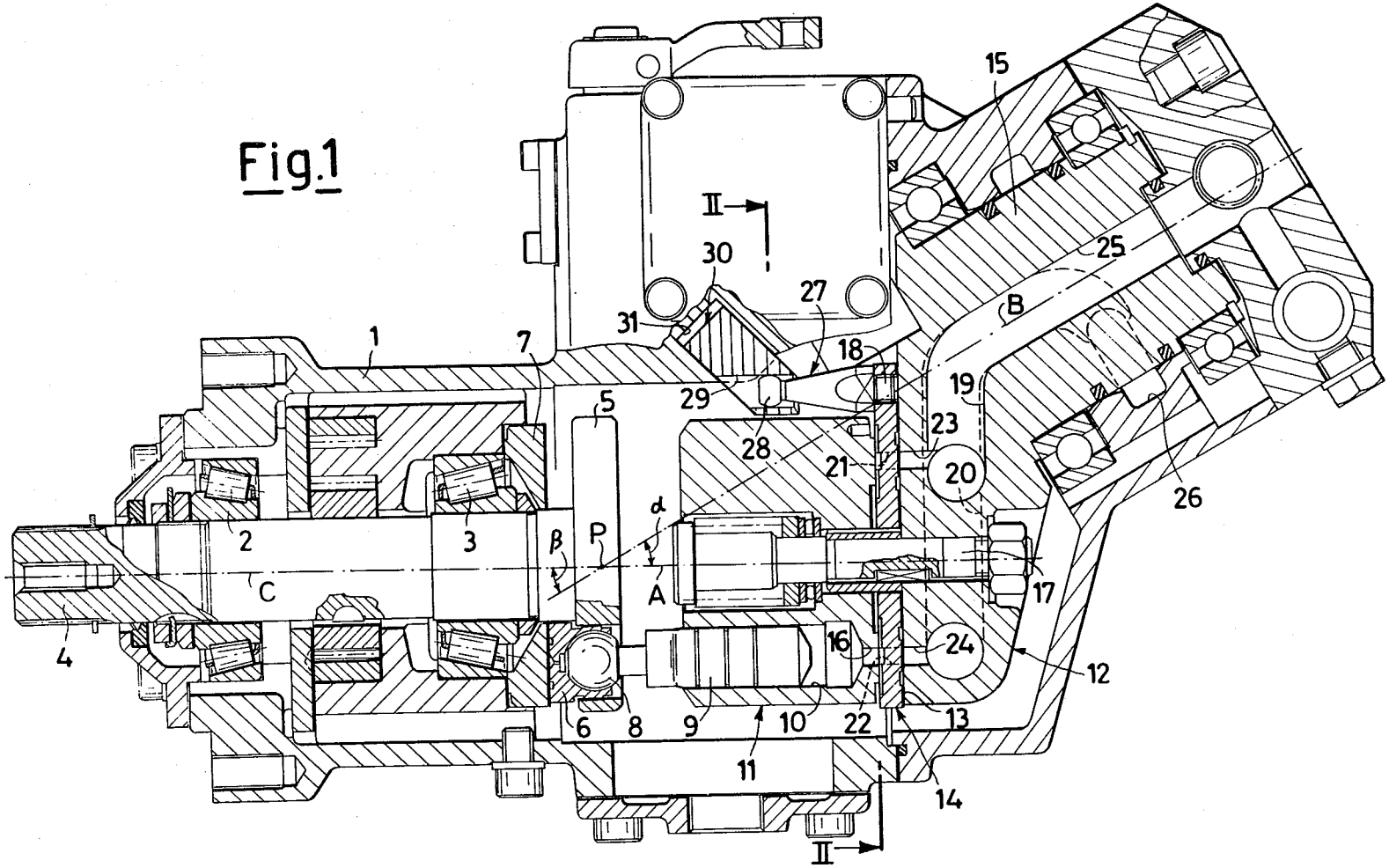
FIG. 1 shows a hydrostatic unit according to the invention, in axial cross-sectional view with the distributor body in the position in which the stroke volume is zero.

The hydrostatic unit shown in the drawings comprises an external casing 1 within which there is supported for rotation, by means of bearings 2 and 3, a drive shaft 4. According to whether the unit is operated as a pump or as a motor, either a control member, or a controlled member, respectively, is provided at the outer end (at the left as viewed in FIG. 1) of the drive shaft 4, said control member or controlled member as the case may be, being of any conventional make.

Figure 2:
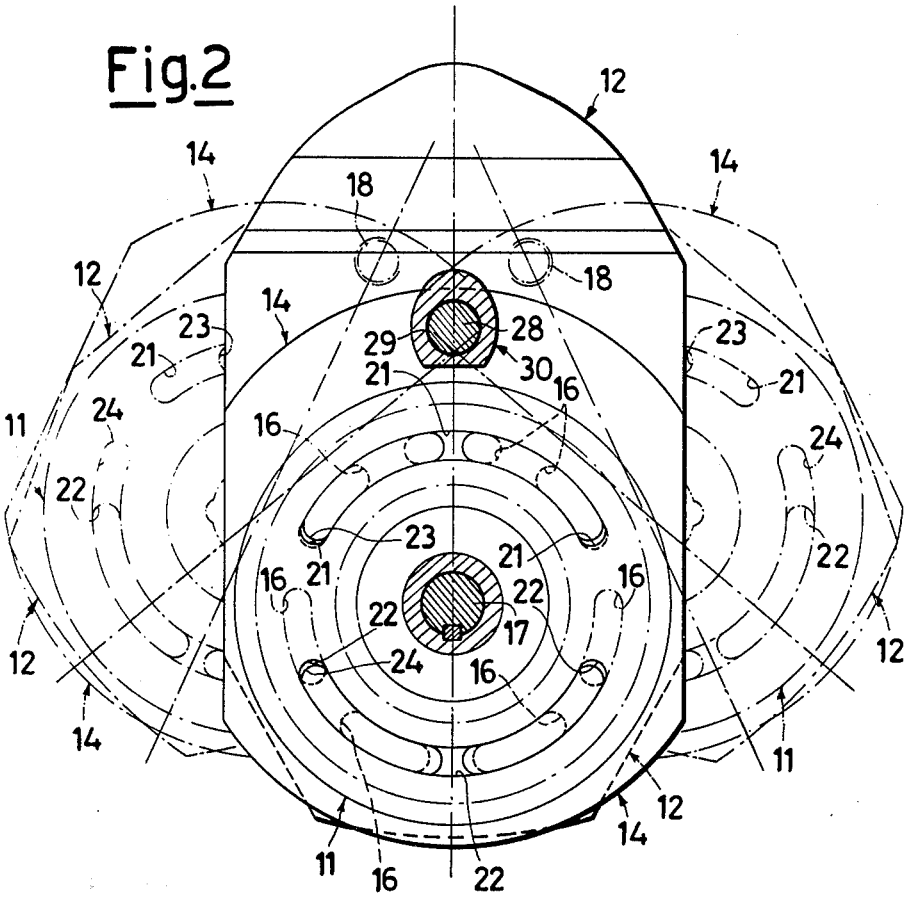
FIG. 2 shows the same unit in cross-sectional view taken along the line II—II of FIG. 1.

At the inner end of the shaft 4, conversely, there is integrally fastened a supporting and driving plate 5 intended for a plurality of circumferentially spaced apart slides 6 which abut in a circumferentially slidable manner a reaction plate 7. Each slide 6 has, universally connected therewith by a spherical head 8, the respective one of a plurality of circumferentially spaced apart pumping pistons 9: each of these latter is slidably engaged in the respective one of a plurality of circumferentially spaced apart parallel cylinders 10 assembled in a cylinder block 11. As shown in FIGS. 1 and 2, each cylinder 10 has a slot 16 for the intake and outflow of the hydraulic fluid intended to flow through the hydrostatic unit.

The cylinder block 11 is pivoted, at 17, to the front surface, 13, of a distributor body, 12. The distributor body 12 is housed in the interior of the casing 1 so as to be rotatable, on command given from outside to a hub 15, about an axis, B, set at an angle beta; relative to the axis of rotation C, of the drive shaft 4. As shown in FIGS. 1 and 2, the axis of rotation A, of the cylinder block 11, passes through the point P, of intersection of the axes B and C, and is set, in its turn, relative to the axis B, at an angle alpha which is equal to beta, so that, as the angular position of the distributor body 12 is varied relative to its axis of rotation B, the cylinder block 11 effects a conical rotation about the axis B. Thus, the cylinder block 11 can become aligned with the drive shaft 4 (position shown in solid lines in FIGS. 1 and 2, and in dash-and-dot lines in FIG. 3, corresponding to a stroke volume of zero), or the cylinder block can form with the drive shaft 4 an angle which is gradually increased up to a value which can be, for example, indicated at 50° (position shown in solid lines in FIG. 3 and in dash-and-dot line in FIG. 2, which corresponds to the maximum stroke volume).

To feed hydraulic fluid to the cylinder block 11 and for receiving it therefrom, the distributor body 12 has a couple of nearly semicircular distribution ports 23, 24 (FIG. 2) with which the slots 16 of the cylinder block 11 periodically communicate during progress of rotation of the cylinder block 11 about the axis A. By way of appropriate channels 19, 20, formed through the distributor body 12, the distribution ports 23, 24 are put in communication with an axial channel 25 and with an annular channel 26, respectively: these latter communicate, in their turn, with fluid intake and outlet mouths specially provided therefor.

In order that shifts of the dead centres of the pistons 9 relative to the distribution ports 23 and 24 may be prevented when the distributor body 12 has to be rotated about its axis B, there is inserted, between the cylinder block 11 and the adjoining surface 13 of the distributor body 12, a phase-adjusting plate 14: the latter has formed therethrough, ports 21 and 22 equal to the distribution ports 23 and 24, of the distributor body 12, which communicate therewith, the plate being enabled to be rotated relative to the distributor body 12 and to the cylinder block 11, about the axis (A) of the pivot 17 of said block.

To either end of the phase-adjusting plate 14, at a point 18 through which the axis of rotation B of the distributor body 12 passes, is rigidly fastened a pivot 27 having a spherical head 28: the latter is housed for rotation and axial sliding in a cylindrical bore 29 of a plunger 30. Plunger 30, in turn, is housed for sliding within a slanting bore 31 of the fixed casing 1.

The operation of the hydrostatic unit shown in the drawings will now be described with reference, for the sake of simplification, to its use as a pump. Nothing changes, in principle, in the case of use as a prime mover.

The rotation impressed to the drive shaft 4 originates a corresponding rotary motion of the pistons 9 and the cylinder block 11 about the axis A of the latter, the result being a pumping action of the pistons 9 relative to the hydraulic fluid being used. The fluid enters through one of the channels 25, 26, reaches the cylinder block 11 via either of the two routes, 19-23-21-20, or 20-24-22, and is then returned to either channel 25 or 26 via the other of said two routes.

The stroke volume, and thus the rate of flow of the fluid, is a function, as outlined above, of the preselected angular setting for the distributor body 12. If such a position is the one shown in dash-and-dot lines in FIG. 2, and in solid lines in FIG. 3, the slope of the axis A of the cylinder block 11 relative to the axis C, of the drive shaft 4, is at its maximum, the stroke volume is consequently at a maximum also. If the angular position of the distributor body 12 and thus that of the cylinder block 11 is, conversely, the one shown in solid lines in FIGS. 1 and 2, the axis A, of the cylinder block 11 is aligned with the axis C, of the drive shaft 4 so that the stroke volume is zero. If, lastly, the angular position of the distributor body 12 is any position intermediate therebetween, then the stroke volume will take any intermediate value between zero and its maximum magnitude.

In order to bring about the rotation of the distributor body 12 to effect the variaton of the stroke volume aforementioned, it is possible to exploit any actuation means associated to the hub 15. For example, a rack-and-pinion assembly actuated by a hydraulic ram can be adopted, or a rotary hydraulic actuator or any other means.

Figure 3:
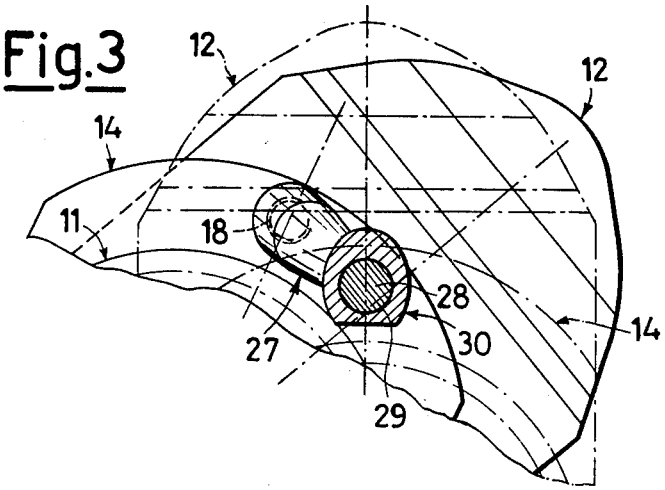
FIG. 3 is a partial reproduction of the view of FIG. 2 but with the distributor body having been rotated relative to the position of stroke volume zero and the phase-adjusting plate, in its turn, having been rotated in the reverse direction relative to the distributor body.

As can be seen in FIGS. 2 and 3, the rotations of the distributor body 12 from the position of stroke volume zero to a position in which the stroke volume is not zero, are accompanied by a different way of rotation of the phase-adjusting plate 14, in the sense that the plate 14 follows the rotary motion of the distributor 12 about the axis B since the plate 14 is bound to the distributor body by the pivot 17. However, since the plate 14 is mounted for rotation about the pivot 17 and, on the other hand, is bound to the fixed casing 1 by the agency of the pivot 27 and the plunger 30, the plate 14 effects also a restricted reverse rotation about the pivot 17 and becomes phase-shifted relative to the distributor body 12, as can be seen in FIG. 3. For the sake of accuracy, the reverse rotation of the phase-adjusting plate 14 is preferably made equal to one half of the rotation of the distributor body 12. As has been ascertained by trials, this circumstance permits to have the dead centres of the pistons 9 centred relative to the ports 21 and 22 of the phase-adjusting plate 14: this effect balances the shift which has taken place, conversely, between such dead centres and the distribution ports 23 and 24 of the distributor body 12. Stated otherwise, such shift is allowed for by causing a phase shift between the ports 21, 22 and 23, 24 (FIG. 2) which is exactly equal and contrary to the shift between the dead centres of the pistons 9 and the distribution ports 23, 24.

On FIG. 1 it can also be seen that the distribution ports 23 and 24, and thus also the corresponding ports 21 and 22 of the phase-adjusting plate 14, are extended transversally of the line conjoining the axes A and C. This circumstance acts in such a way that the upper dead centre of the pistons lies between the two left ends (as viewed in FIG. 2) of the distribution ports 23, 24 in the case of a clockwise rotation (still as viewed in FIG. 2) of the distributor body 12, while it lies between the right side ends of the distribution ports if the rotation is counterclockwise. The direction of delivery of the pump can thus be reversed without changing the direction of rotation of the drive shaft 4, but by merely rotating the distributor body 12 to either side relative to the position of stroke volume zero.

I claim:

1. A hydrostatic unit with axial pistons, comprising a drive shaft carrying integrally a driving plate for a plurality of circumferentially spaced apart pumping pistons, a cylinder block equipped with a plurality of parallel circumferentially spaced apart cylinders in which such pumping pistons are slidably engaged, and a distributor body carrying said cylinder block in a manner freely rotatable about a medium axis thereof and equipped additionally with a couple of distribution ports for a hydraulic fluid, said ports being capable of communicating alternately with respective intake and outlet ports of said cylinders, said distributor body being rotatable on command about an axis inclined relative to the axis of the drive shaft and carrying said cylinder block so that the axis of rotation of the latter passes through the point of intersection between said axis of the distributor body and of the drive shaft and is inclined in its turn relative to said axis of the distributor, a phase-adjusting plate inserted between the cylinder block and the corresponding surface of the distributor body said plate having formed therethrough ports identical to those of the distributor body and communicating therewith, said phase-adjusting plate being rotatable about the axis of the cylinder block, means being provided responsive to each rotation of the distributor body about its own axis by a simultaneous and opposite rotation of the phase-adjusting plate about the axis of the cylinder block through such an angle as to keep the dead centers of the pistons constantly centered relative to said ports of the phase-adjusting plate and so as to allow for the shift of the dead centers relative to the distribution ports, said means being formed by a pivot rigidly affixed to said phase-adjusting plate and connected for rotation and sliding to the fixed casing of the hydrostatic unit.

2. A hydrostatic unit with axial pistons, comprising a drive shaft carrying integrally a driving plate for a plurality of circumferentially spaced apart pumping pistons, a cylinder block equipped with a plurality of parallel circumferentially spaced apart cylinders in which such pumping pistons are slidably engaged, and a distributor body carrying said cylinder block in a manner freely rotatable about a medium axis thereof and equipped additionally with a couple of distribution ports for a hydraulic fluid, said ports being capable of communicating alternately with respective intake and outlet ports of said cylinders, said distributor body being rotatable on command about an axis inclined relative to the axis of the drive shaft and carrying said cylinder block so that the axis of rotation of the latter passes through the point of intersection between said axes of the distributor body and of the drive shaft and is inclined in its turn relative to said axis of the distributor, a phase-adjusting plate inserted between the cylinder block and the corresponding surface of the distributor body said plate having formed therethrough ports identical to those of the distributor body and communicating therewith, said phase-adjusting plate being rotatable about the axis of the cylinder block, means being provided responsive to each rotation of the distributor body about its own axis by a simultaneous and opposite rotation of the phase-adjusting plate about the axis of the cylinder block through such an angle as to keep the dead centers of the pistons constantly centered relative to said ports of the phase-adjusting plate and so as to allow for the shift of the dead centers relative to the distribution ports which are extended transversally of the line conjoining the axes of rotation of the distributor body and the cylinder block so as to effect the reversal of the direction of delivery by the reversal of the direction of rotation of the distributor body.

* * * * *